United States Patent [19]

Lechner et al.

[11] Patent Number: 5,052,463

[45] Date of Patent: Oct. 1, 1991

[54] METHOD FOR PRODUCING A PIPE SECTION WITH AN INTERNAL HEAT INSULATION LINING

[75] Inventors: Manfred Lechner, Munich; Dieter Kunzmann, Taufkirchen, both of Fed. Rep. of Germany

[73] Assignee: Messerschmitt-Boelkow-Blohm GmbH, Munich, Fed. Rep. of Germany

[21] Appl. No.: 491,299

[22] Filed: Mar. 9, 1990

[30] Foreign Application Priority Data

Mar. 11, 1989 [DE] Fed. Rep. of Germany ..... 3907923

[51] Int. Cl.[5] ..... B22D 19/14; B22C 9/04

[52] U.S. Cl. ..... 164/35; 164/98

[58] Field of Search ..... 164/35, 97, 98, 108, 164/110, 100

[56] References Cited

U.S. PATENT DOCUMENTS 4,508,158 4/1985 Amateau et al. ..... 164/97

FOREIGN PATENT DOCUMENTS

| | | | |
|---|---|---|---|
| 2354254 | 5/1974 | Fed. Rep. of Germany . | |
| 3241513 | 5/1984 | Fed. Rep. of Germany . | |
| 58-13464 | 1/1983 | Japan | 164/98 |
| 60-9569 | 1/1985 | Japan | 164/97 |
| 62-187562 | 8/1987 | Japan | 164/108 |
| 2194277 | 3/1988 | United Kingdom | 164/100 |

*Primary Examiner*—Kuang Y. Lin
*Attorney, Agent, or Firm*—W. G. Fasse

[57] ABSTRACT

A pipe section, especially an elbow pipe section, is cast to have an internal heat insulation lining so that the pipe section can withstand temperatures up to about 2500° C. The internal heat insulation is first formed as a hollow casting core of carbon fiber composite material which, after curing, is inserted into a casting mold to function as the casting core which then becomes the internal heat insulation of the pipe section as the result of the casting of the pipe section, whereby the carbon fiber composite material is bonded to the interior surface of the pipe section.

15 Claims, 8 Drawing Sheets

METHOD FOR PRODUCING A PIPE SECTION WITH AN INTERNAL HEAT INSULATION LINING

FIELD OF THE INVENTION

The invention relates to a method for producing a pipe section with an internal heat insulation, especially a pipe section having an elbow shape. The invention also relates to a pipe section formed according to the present method with an internal heat insulation lining.

BACKGROUND INFORMATION

German Patent Publication (DE-OS) 3,241,513 discloses the manufacture of tempered rovings or textile type structures, such as webbings made of synthetic fibers, which are individually nickel coated. Such rovings or textile type materials are used for the production of aircraft outer skins, thereby providing an increased protection of the aircraft against being struck by lightning. Such rovings and textile type materials have an increased electrical conductivity at higher temperatures. However, the materials in which the individual fibers are nickel coated are not suitable for the production of shaped structural components such as pipe sections or the like, which are exposed to high temperature loading under long duration operating conditions such as is the case for the exhaust elbows of combustion engines or similar components exposed to high operating temperatures.

It is also known to provide such pipe sections, for example, an exhaust pipe elbow cast of metal, with an internal ceramic lining which is capable of withstanding temperatures up to about 1700° C. However, the linings of ceramic materials under such operating conditions have a tendency to generate cracks due to the shrinking that may result from the casting of the respective pipe section. As a result, the ceramic linings do not very well stand up against the actually occurring high temperatures and to the erosive exhaust gases in a reliable manner.

OBJECTS OF THE INVENTION

In view of the foregoing it is the aim of the invention to achieve the following objects singly or in combination:

to provide a method for manufacturing of pipe sections, including elbow pipe sections and the like, which are capable of withstanding long duration high temperature loads up to 2500° C. in a reliable manner without generating cracks;

to form a casting core and use such a core in the casting operation in such a way that the core, after the casting becomes an integral lining on the internal surface of the cast structural component;

to use carbon fiber composite materials as the material for making the casting core which then becomes the lining of the cast component; and to provide a high temperature resistant pipe section, such as an elbow pipe section, which has an internal integral lining of high temperature resistant material, such as carbon fiber composite material.

SUMMARY OF THE INVENTION

The pipe section according to the invention is manufactured by the following steps. First, a hollow casting core of carbon fiber carbon material is formed. When the core has been cured it is mounted in a casting mold, whereby care is taken that the melt of which the pipe section is to be cast, cannot enter into the hollow casting core. Next, the casting of the pipe section is performed by introducing a high temperature resistant metal melt, such as a nickel base alloy, into the casting mold, whereby the pipe section is formed around and bonded to the hollow casting core which becomes an integral internal heat insulation lining. When the pipe section has solidified, it is removed, together with its internal heat insulation, from the casting mold.

In a preferred embodiment the hollow casting core of carbon fiber carbon material is provided on its outer surface with a nickel coating and with a platinum layer on the nickel coating while the inner surface is coated with silicon carbide.

BRIEF DESCRIPTION OF THE DRAWINGS

In order that the invention may be clearly understood, it will now be described, by way of example, with reference to the accompanying drawings, wherein.

DETAILED DESCRIPTION OF A PREFERRED EXAMPLE EMBODIMENT AND OF THE BEST MODE OF THE INVENTION

FIGS. 1 to 4 illustrate the manufacture of a pipe section in the form of a pipe elbow that may, for example, be used as an ignition elbow or manifold in an internal combustion engine. Such pipe sections must be capable of operating for prolonged periods of time under high temperature conditions up to 2500° C. These pipe elbows must be capable of withstanding these temperatures without developing cracks while simultaneously having a corrosion preventing characteristic which prevents the ignition gases or exhaust gases from corroding the pipe elbow 200. For this purpose the pipe elbow 200 is provided on its inner surface with a high temperature resistant inner lining integrally bonded to the inside of the pipe elbow. The formation of such a lining poses problems since it is not possible to efficiently form such a lining after the metal portion of the pipe elbow has been formed by casting. The invention avoids this problem by securing the inner high temperature resistant lining to the inner surface of the pipe elbow during the casting.

Figure 1:
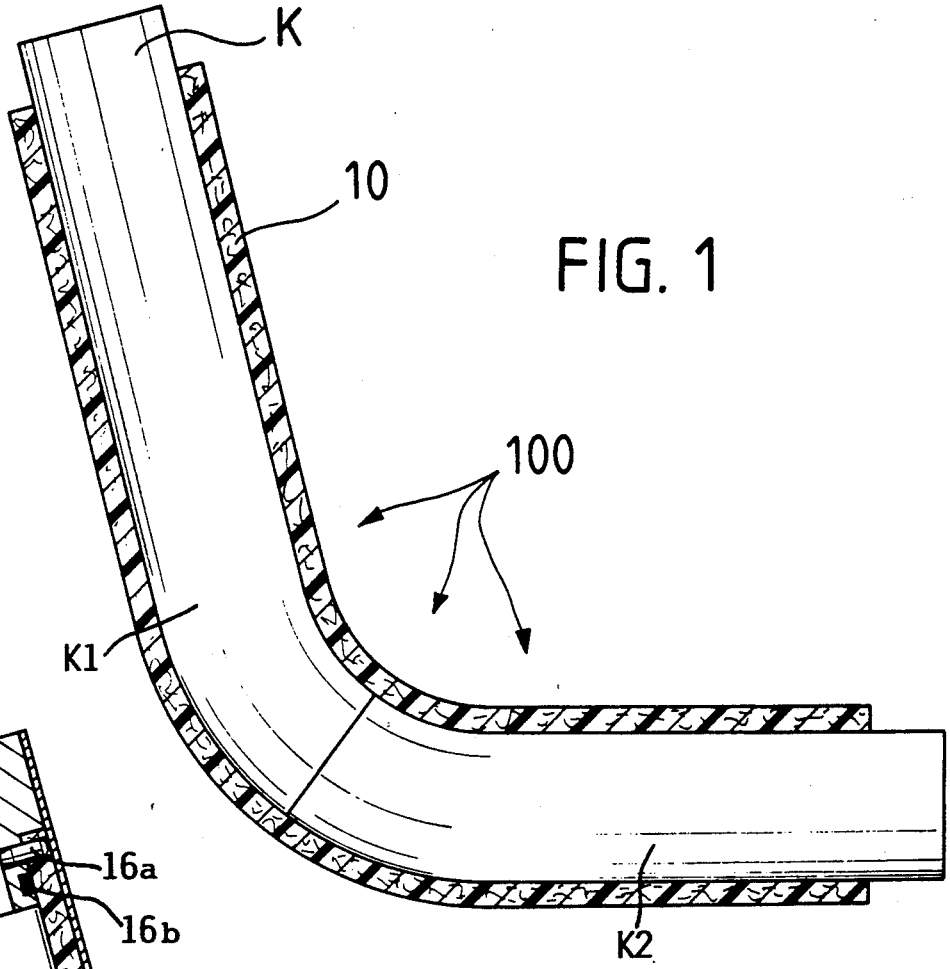
FIG. 1 shows a sectional view through a hollow jacket still on a jacket core, said jacket being subsequently used to form a casting core which will still later become a heat resistant liner.

FIG. 1 shows that the first step in the manufacturing sequence of a pipe section according to the invention involves the formation or provision of a removable hollow jacket core K having a configuration of the pipe section, more specifically, of the flow channel through the pipe section. By dividing the core into a number of sections K1, K2 it is easy to remove the core after the heat insulating jacket has been formed on the core.

In the next step the heat insulating jacket is formed on the core by winding or layering preimpregnated carbon fiber composite material onto the core, for example, in the form of so-called CFC-prepregs to form the jacket 10 which is then permitted to cure. CFC-prepregs comprise reinforcing carbon fibers embedded in a carbon matrix. The jacket is formed to a wall thickness of several mm, for example 4 mm. Once the jacket has cured, both core sections K1 and K2 are removed, whereby the jacket 10 becomes hollow and forms a molding or casting core 100 of fiber composite material wherein the carbon fibers are embedded in a carbon matrix material.

Figure 2:
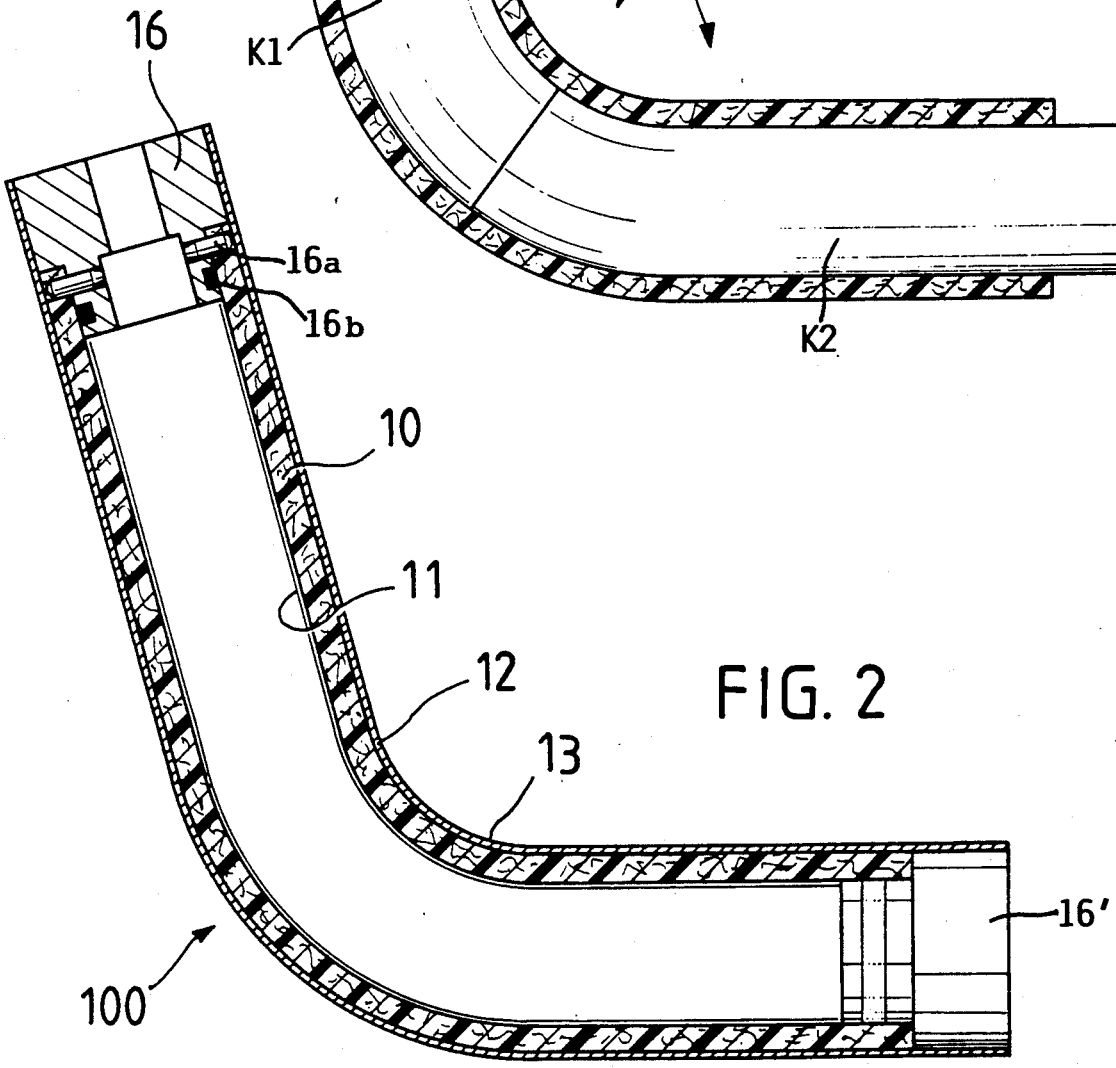
FIG. 2 is a view similar to that of FIG. 1, however, showing a casting core with its coatings on its outside and on its inside surfaces.
Figure 3:
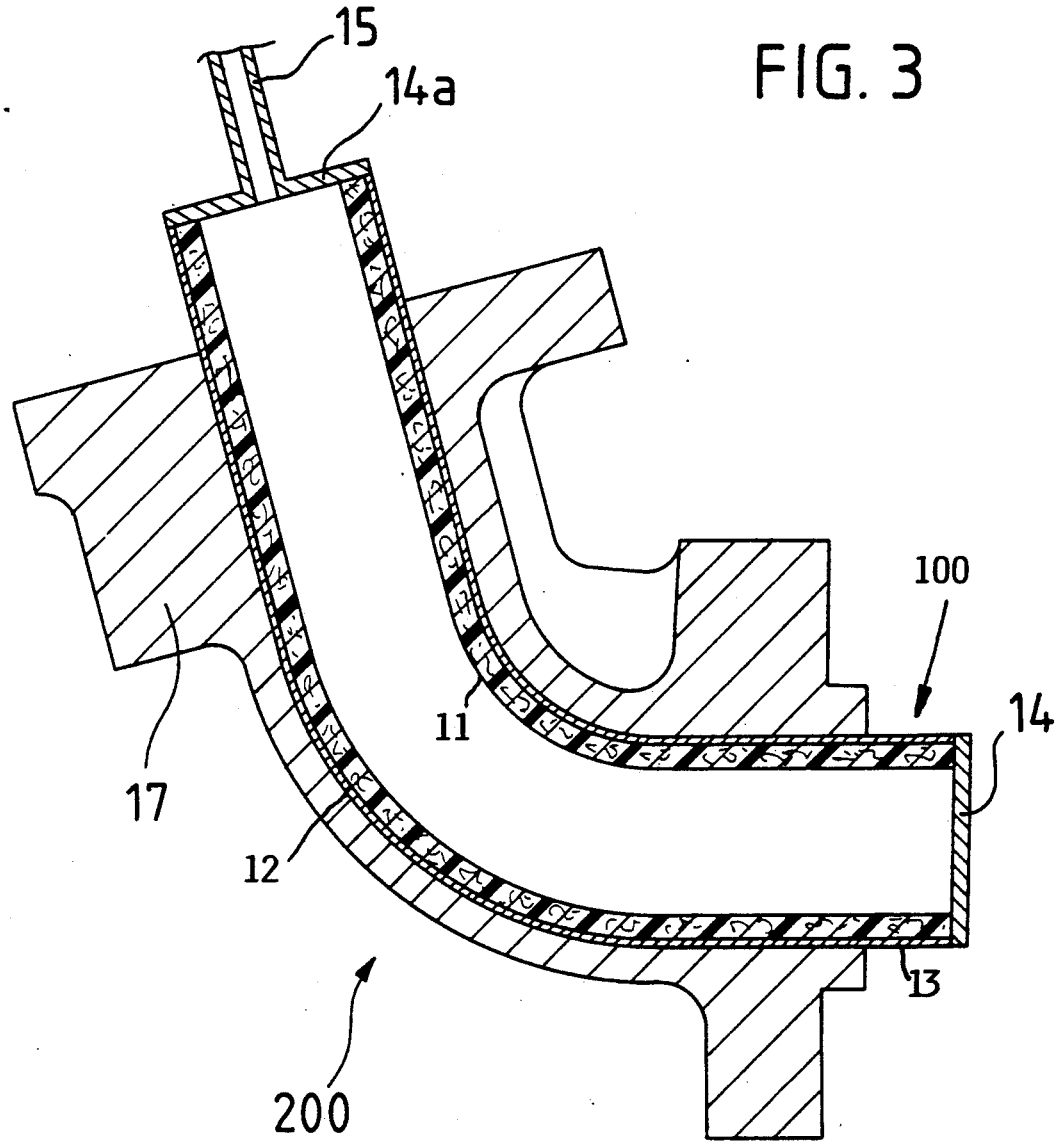
FIG. 3 shows a sectional view through a cast elbow pipe section after its removal from the casting mold with the casting core now forming the heat resistant liner inside the cast elbow pipe but prior to a finishing operation.

A silicon carbide coating 11 is now applied to the inner surface of the hollow casting core 100. This silicon carbide coating may, for example, be applied by a vapor deposition or the like. Once the silicon carbide coating 11 has been applied, the casting or molding core 100 is closed at its ends by closure members 16 and 16' as shown in FIG. 2. The closure member 16 is constructed for mounting the core 100 in a galvanic bath. The closure member 16 has a number of spring biased clamping pins **16*a* which press into the jacket 10. A seal 16*b* makes sure that the galvanic bath liquid cannot enter into the interior of the core 100. Since the core 100 is an electrical insulator, it is first coated with a nickel coating in a currentless manner until any irregularities or pores in the surface of the core 100 are closed and until the surface of the core becomes electrically conductive. Thereafter, the so-prepared core is inserted into a sulfate nickel bath and the nickel coating 12 is formed to a thickness of between 0.5 mm to maximally about 1 mm. Once the nickel coating 12 has been formed, the closure member 16 and 16' are removed, if necessary, the end faces are mechanically cut clean and closed by nickel covers 14 and 14*a* as shown in FIG. 3. These covers are welded tight so that the interior of the casting core 100 can be either vented through a port 15 to the atmosphere, or a protective gas can be introduced through the port 15 into the interior of the casting core 100. The port 15 is preferably secured to respective cover 14*a* before the cover is used for closing the casting core 100. After the casting core 100 has been closed as just described, a platinum layer 13 is applied to the outer surface of the nickel coating 12. The platinum layer 13 may, for example, be also applied in a galvanic bath. The platinum coating provides an optimal protection against oxidation during the following manufacturing steps. Additionally, the platinum provides an excellent bonding between the casting core, more specifically between the nickel coating 12 and the pipe section 17 shown in FIG. 3. Layer 13** has a thickness within the range of 0.001 to 0.5 mm.

The so-prepared casting core 100 is now ready for use as a core in the subsequent vacuum casting of the pipe section 17. For this purpose, a wax model having the configuration of the pipe section 17 shown in FIG. 3 is formed around the casting core 100. For an example the core may be inserted into the wax model or the wax model may be cast around the core 100. In any event, the core 100 will be partially encased in the wax model so that at least the end portions shown in FIG. 3 protrude from the wax model which takes up the space of the pipe section 17. In fact, it can be assumed that the shape of the wax model corresponds exactly to the shape of the pipe section 17 shown in FIG. 3.

Figure 4:
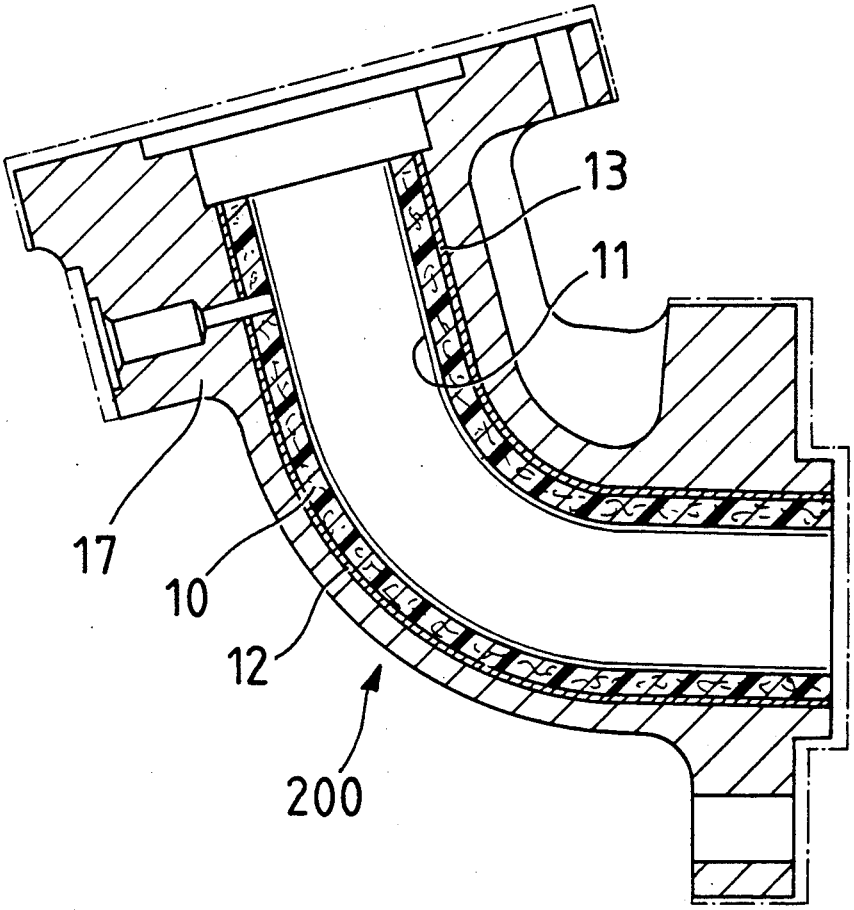
FIG. 4 shows a finished pipe elbow with the heat resistant inner lining produced according to the invention.

After the wax model has sufficiently solidified, a green ceramic material is supplied to the wax model with the casting core at least partly encased in the wax model. The green ceramic material with the wax model inside of the green ceramic material is then fired to form a ceramic mold, whereby the wax model melts out of the ceramic mold while the casting core remains in a proper position inside the ceramic mold, however, with the ends of the core protruding from the ceramic mold. The temperature at which the ceramic mold is formed and the wax melted out, is within the range of 800° C. to 1100° C. and the firing takes place preferably in an oxygen atmosphere. The platinum layer 13 prevents the oxidation of the nickel coating 12. The so formed ceramic mold is now ready for casting a high temperature resistant metal alloy melt, such as a nickel base alloy, into the ceramic mold, whereby the pipe section 17 is formed around and bonded to the casting core 100 which thereby becomes the internal heat insulation lining inside the pipe section 17. After the melt has solidified, the pipe section 17 is removed from the ceramic mold, including the internal heat insulation lining. Any machining steps are then performed, for example, to shape the ends of the pipe section for connection to other pipe sections as shown in FIG. 4.

As a result of the casting operation, and subsequently during the cooling operation, the platinum layer 13 diffuses into the nickel alloy of the pipe section 17 and also into the nickel coating 12, whereby an intimate bonding is achieved between the inner heat insulating lining formed by the jacket 10 and the inner surface of the pipe section 17. Thus, this bonding securely anchors the two components to each other so that the machining operation such as cutting, plane turning, and so forth, including the formation of bores and center bores, can be performed to achieve the final product shown in FIG. 4.

It will be apparent from the above disclosure that, according to the invention, only the entire jacket, or rather its outer surface, is provided with the nickel coating 12 rather than coating the individual fibers with nickel.

The above mentioned nickel coating has preferably a thickness within the range of about 0.5 to about 1.0 mm, as mentioned. It will be appreciated that the just described sequence of steps is the preferred way of manufacturing a high quality pipe section such as an elbow or manifold which has excellent heat resisting capabilities. However, in its simpler version, the present method can be performed by first making a hollow casting core of carbon fiber carbon material which is then mounted in a casting mold, whereupon the casting takes place by introducing a high temperature resistant metal melt into the casting mold so that the pipe section is formed directly around and bonded to the carbon fiber carbon material of the hollow casting core, whereby care is taken that the melt does not enter into the hollow core. Once the pipe has solidified, it is removed with its inner core lining from the mold.

FIG. 1 shows the jacket 10 made of carbon fiber phenolic resin composite material wound or laminated onto the core sections K1, K2.

FIG. 2 shows the jacket 10 of carbon-carbon-composite material with a silicon carbide layer 11 on the inside and a nickel layer 12 on the outside. The jacket is held in mountings 16, 16' for the galvanizing.

FIG. 3 shows a carbon-carbon jacket encasted by the pipe elbow 200 with the ceramic mold removed and the inlet casting funnel and riser also removed.

FIG. 4 shows the pipe elbow or igniter elbow 200 after final machining, whereby the dash-dotted lines indicate material that has been removed by mechanical machining. A connector inlet for a pressure or temperature measuring connection is shown in the upper left-hand corner.

Figure 5:
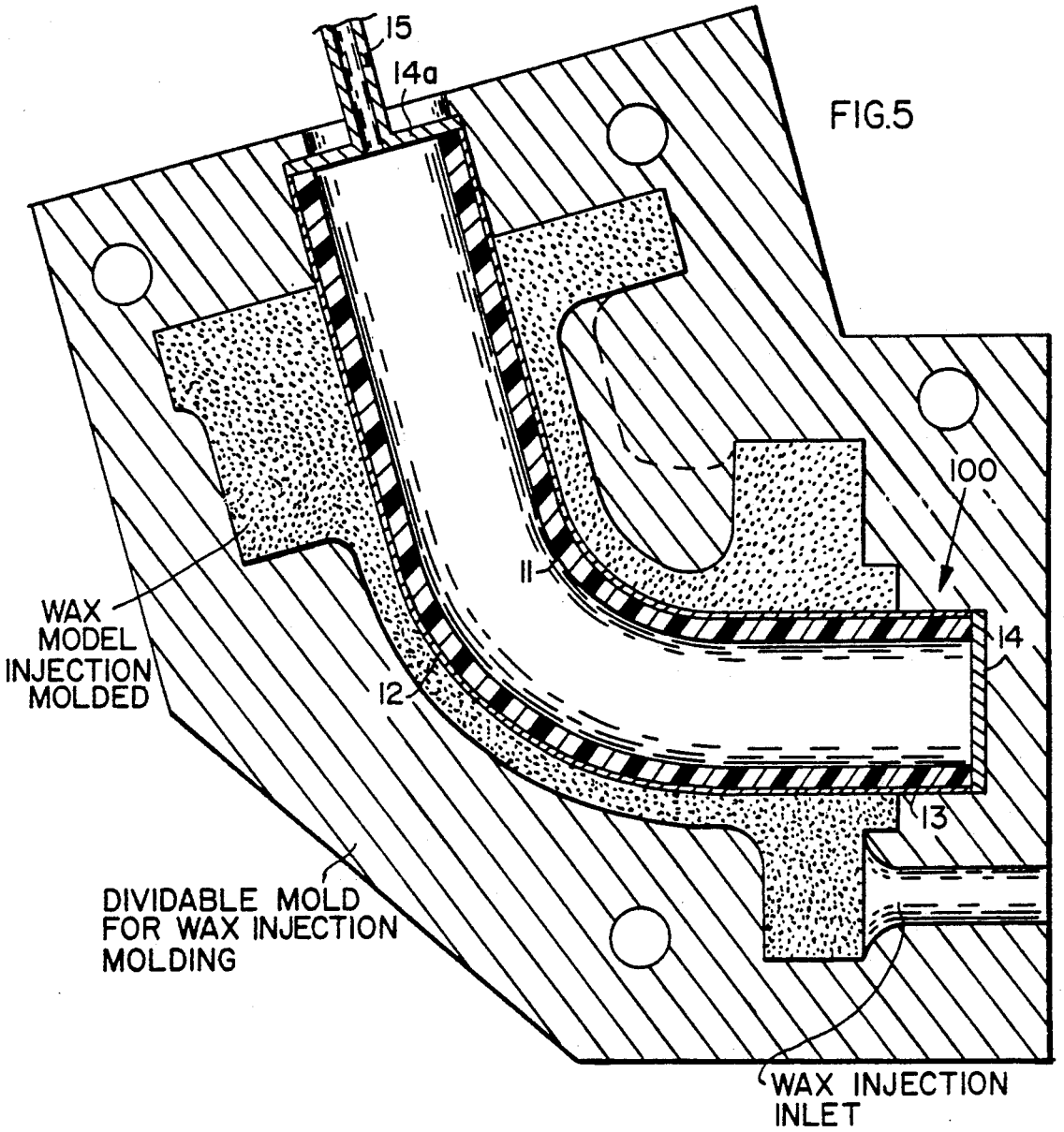
FIG. 5 shows the formation of a wax model in an injection mold around the liner.

FIG. 5 shows the liner 100 inserted in a wax injection mold which is dividable and into which a wax model has been injection molded.

Figure 6:
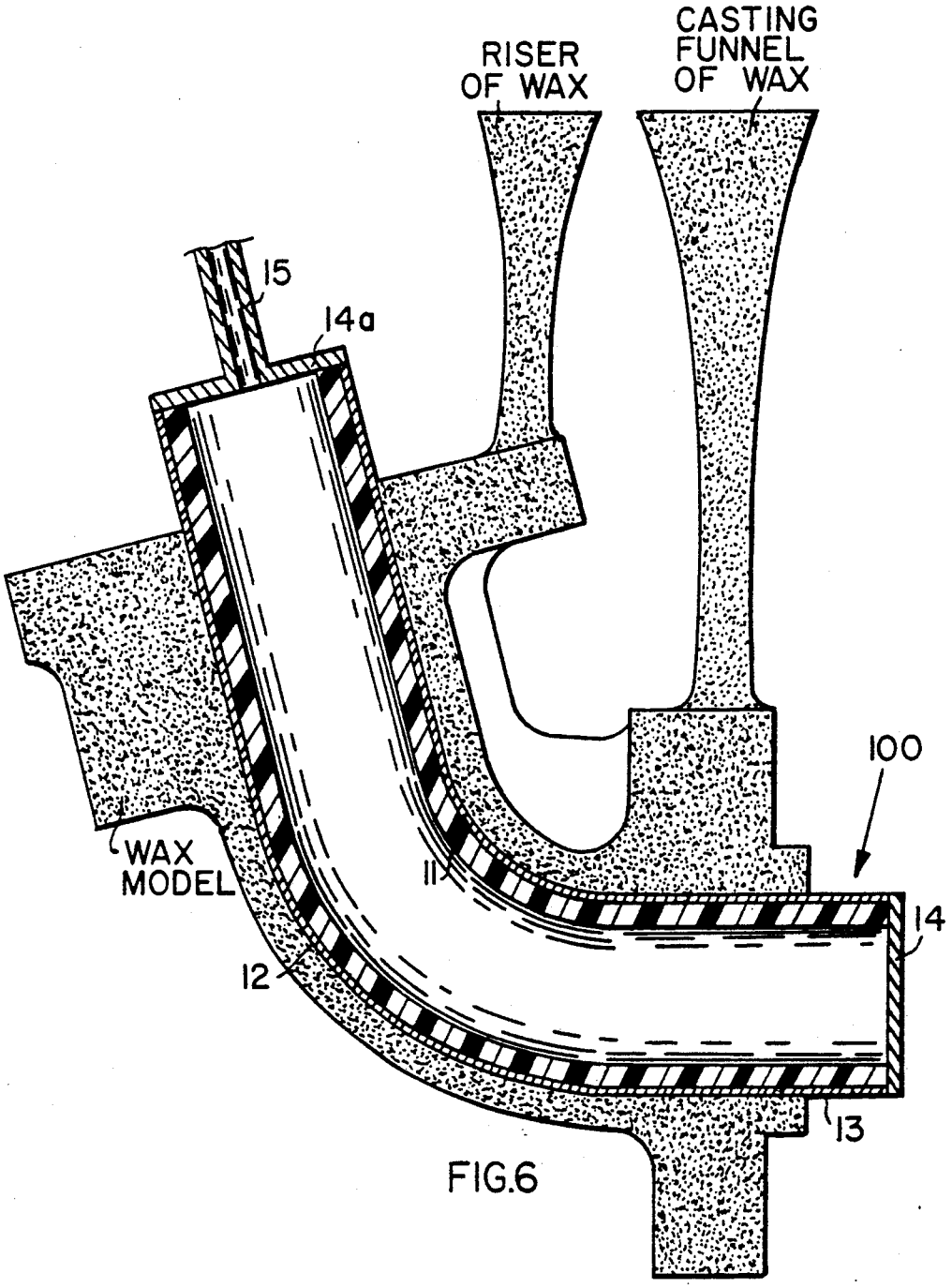
FIG. 6 shows the wax model after removal of the injection mold.

FIG. 6 shows the carbon-carbon liner 100 with the wax model surrounding the liner and with a casting funnel and riser made of wax.

Figure 7:
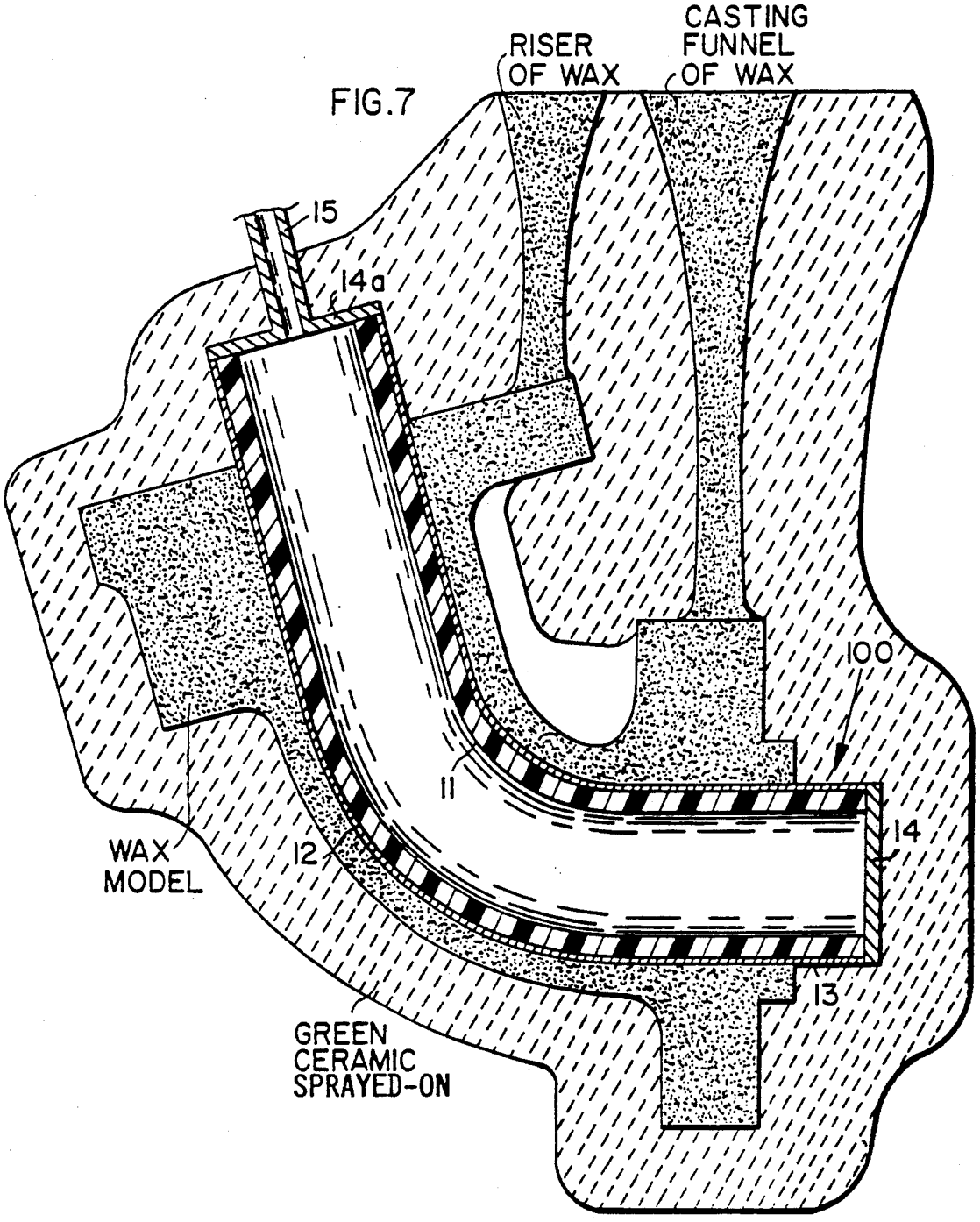
FIG. 7 shows the wax model of FIG. 6 after spray-on of green ceramic.

FIG. 7 shows the carbon-carbon liner 100 with a wax model surrounding the liner and with a riser as well as casting funnel also made of wax. The wax model with its riser and funnel are enveloped by green sprayed-on ceramic.

Figure 8:
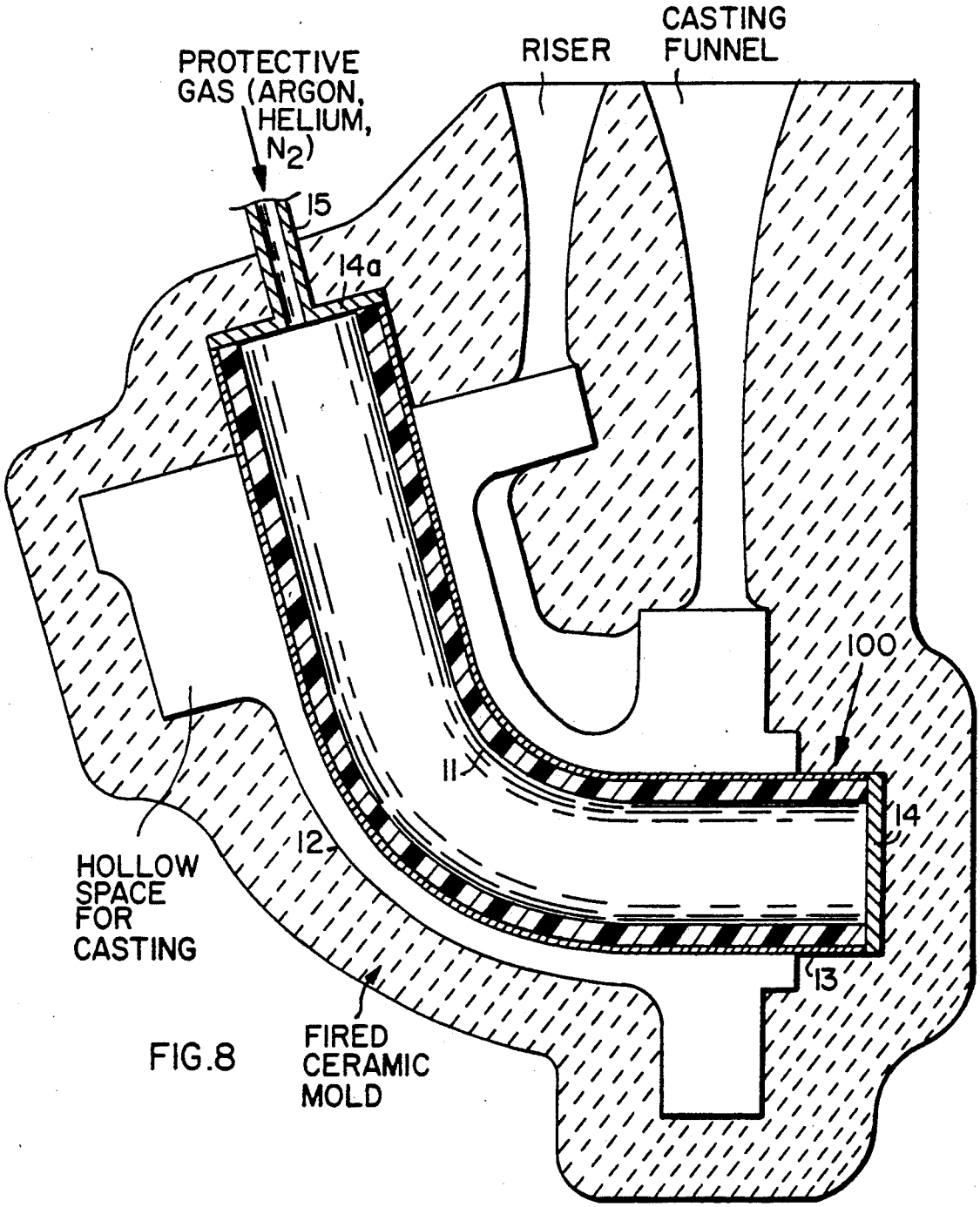
FIG. 8 shows the ceramic mold after firing the green ceramic of FIG. 7.

FIG. 8 shows the carbon-carbon liner 100 inside a fired ceramic mold out of which the wax model has been burned-out to form a hollow casting space.

Figure 9:
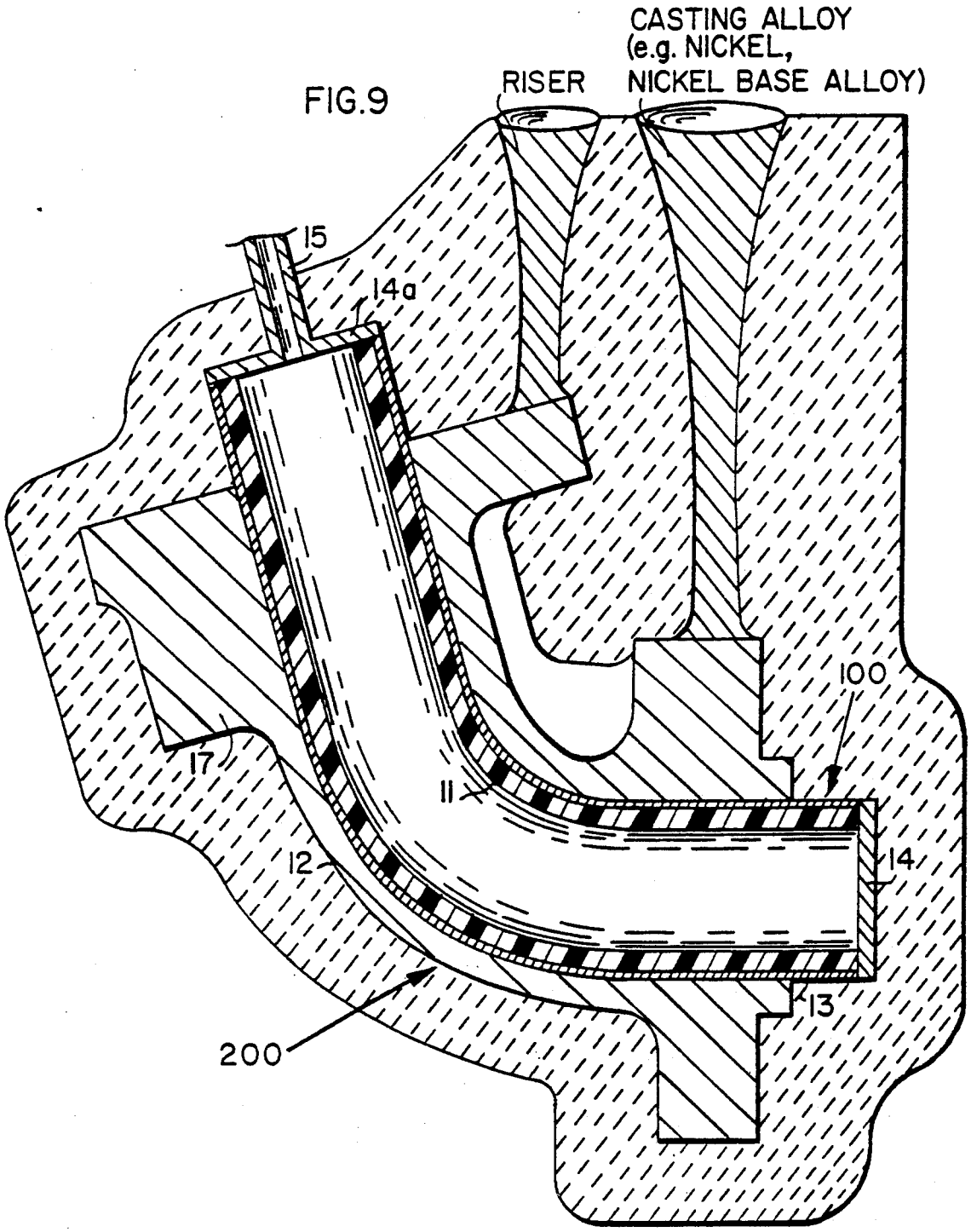
FIG. 9 shows the cast elbow pipe prior to the removal of the ceramic mold.

FIG. 9 shows the carbon-carbon liner 100 inside a cast nickel base alloy elbow 17.

Although the invention has been described with reference to specific example embodiments it will be appreciated that it is intended to cover all modifications and equivalents within the scope of the appended claims.

What we claim is:

1. A method for producing a pipe section with an internal heat insulation lining, comprising the following steps:

(a) providing a removable jacket core having a configuration of said pipe section, (b) applying a heat resistant carbon fiber composite, wherein the carbon fibers are embedded in a carbon matrix, onto the outside of said jacket core to form a heat insulating jacket having said configuration, (c) removing said jacket core from said heat insulating jacket to provide a hollow heat insulating jacket still having said configuration, (d) applying a silicon carbide coating to an inner surface of said hollow heat insulating jacket, (e) applying a nickel coating onto an outer surface of said hollow heat insulating jacket.

(f) closing each end of said hollow heat insulating jacket with a nickel cover to form a closed, yet hollow heat insulating casting core, (g) applying a platinum layer to an outer surface of said nickel coating on said closed hollow heat insulating casting core, (h) forming a wax model of said pipe section around said hollow casting core so that said casting core is at least partly encased in said wax model, (i) applying a green ceramic material to said wax model with said casting core at least partly encased in said wax model, (j) firing said green ceramic material to form a ceramic mold, whereby said wax model melts out of said ceramic mold while said casting core remains in proper position in said ceramic mold, (k) casting a high temperature resistant metal alloy melt into said ceramic mold, whereby said pipe section is formed around and bonded to said hollow casting core which becomes said internal heat insulation lining inside said pipe section integrally bonded to said pipe section, (l) removing, after said melt has solidified, said pipe section with its internal heat insulation from said ceramic mold, and (m) finishing said pipe section.

2. The method of claim 1, wherein said step (e) of applying said nickel coating is continued until said nickel coating has a thickness within the range of about 0.5 to 1.0 mm.

3. The method of claim 1, wherein said high temperature resistant metal alloy is a nickel base alloy.

4. The method of claim 1, wherein said step (j) of firing said green ceramic material and melting out said wax model is performed in an oxygen atmosphere at a temperature within the range of 800° C. to 1100° C.

5. The method of claim 1, wherein said step (e) of applying said nickel coating is performed by first applying a nickel coating to said jacket in a currentless manner until said outer surface of said jacket becomes electrically conducting, and then continuing said applying of said nickel coating in a galvanizing sulphate nickel bath until said nickel coating has a thickness of about 0.5 to 1.0 mm.

6. The method of claim 1, further comprising providing at least one of said nickel covers with port means for venting an interior space in said casting core and for introducing a protective gas into said casting core.

7. The method of claim 6, wherein said port means are secured in said one nickel cover prior to said closing step (f).

8. The method of claim 1, wherein said pipe section is formed as an elbow pipe section.

9. A method for producing a pipe section with an internal heat insulation lining, comprising the following steps:

(a) manufacturing a hollow casting core of carbon fiber composite material, wherein the carbon fibers are embedded in a carbon matrix, (b) mounting said hollow casting core in a casting mold, (c) casting said pipe section by introducing a high temperature resistant metal melt into said casting mold, whereby said pipe section is formed around and bonded to said hollow casting core which becomes said internal heat insulation as an integral lining of said pipe section, and (d) removing the solidified pipe section with its internal heat insulation lining from said mold.

10. The method of claim 9, further comprising providing said hollow casting core on its outside with a nickel coating, and on its inside with a silicon carbide coating prior to casting.

11. The method of claim 10, further comprising applying a platinum coating on said nickel coating prior to inserting said casting core into said casting mold.

12. The method of claim 9, wherein said hollow casting core is mounted in said casting mold so that ends of said hollow casting core project in a sealed manner outside of said casting mold, whereby melt cannot enter into said hollow casting core.

13. The method of claim 12, wherein said projecting ends are severed after removal of said pipe section from said casting mold.

14. The method of claim 9, wherein said pipe section is formed as an elbow pipe section .

15. The method of claim 9, further comprising introducing into said hollow casting core a protective gas, so that said protective gas is present in said hollow core at least during casting.

* * * * *